US005149097A

United States Patent [19]

Tonello et al.

[11] Patent Number: 5,149,097

[45] Date of Patent: Sep. 22, 1992

[54] CROSSWORD PUZZLE AID

[76] Inventors: John H. Tonello, 11 Five Corners Rd., Centerville, Mass. 02632; Michael J. Tonello, 13 Dartmouth St., Boston, Mass. 02116

[21] Appl. No.: 694,145

[22] Filed: May 1, 1991

[51] Int. Cl.[5] ..... A63F 9/00; G09B 1/28

[52] U.S. Cl. ..... 273/148 R; 273/272; 434/172; 434/177; 434/175

[58] Field of Search ..... 273/148 R, 272, 283; 434/172, 175–177

[56] References Cited

U.S. PATENT DOCUMENTS

| | | | |
|---|---|---|---|
| Des. 169,562 | 5/1953 | Rieck | 434/172 |
| 2,848,824 | 8/1958 | Donaldson | 434/177 |
| 3,765,107 | 10/1973 | Cameron | 434/172 |
| 3,947,036 | 3/1976 | Kupec | 273/272 |
| 4,227,697 | 10/1980 | Castanis | 273/272 |

*Primary Examiner*—Benjamin Layno

*Attorney, Agent, or Firm*—Wolf, Greenfield & Sacks

[57] ABSTRACT

A word puzzle device in which an unknown word is solved by substituting, for each of the unknown letters, the letters of the alphabet, and combining these letters with the letters known to exist in the unknown word to determine the identity of the word. The word puzzle device includes a plurality of elongated strips each having two sets of equally spaced letters. One set of letters is oriented vertically and another of said sets is oriented horizontally. A housing retains said plurality of strips in parallel and for longitudinal movement and has a first opening for viewing said vertically oriented letters and a second opening for viewing said horizontally oriented letters on each of said plurality of strips. The strips are moved to display different letter combinations through said openings. By combining letters of the alphabet, for any known letter, with letters known to form part of the unknown word, the unknown word can be discovered.

10 Claims, 2 Drawing Sheets

CROSSWORD PUZZLE AID

FIELD OF THE INVENTION

This invention relates generally to a word puzzle aid, and more particularly to a word puzzle aid for assisting a person in solving the unknown letters in a word puzzle by substituting unknown letters in combination with known letters to determine the answer to a word puzzle.

BACKGROUND OF THE INVENTION

The crossword puzzle, scrambled word game Jumble ® and Scrabble ® are just a few of the many popular word puzzles played throughout the world. These word puzzles, while being fun, enjoyable and rewarding, are also frequently quite frustrating. Anyone who has ever done a challenging word puzzle is well aware of how frustrating it is to have obtained some of the letters in a word puzzle, while not being able to solve the one, or more, missing letter which is necessary to the puzzle's solution. With some puzzles the answers are found on another page of the publication, or are published at some future time. A typical word puzzle solver often believes, however, that referring to the answers constitutes cheating, and that with just a little help a solution to the unsolved word could indeed be obtained.

One example of a word puzzle aid is the popular crossword puzzle dictionary. In order to use the crossword puzzle dictionary, however, one must know at least the first few letters of the word to be solved. More importantly, this kind of dictionary removes all of the fun in solving a word puzzle by providing the unknown word in whole. Another problem with the crossword puzzle dictionary is that it is a fixed medium which makes it difficult to visualize the possible combinations of unknown letters that may be combined with the known letters to form the unknown word.

It is, therefore, an object of this invention to provide a word puzzle aid for assisting in the determination of a word by combining unknown letters with the letters known to be a part of the word to be solved.

Another object of the invention is to provide assistance in solving for an unknown word in a puzzle, based on some known letters, in a way which permits the maximum fun and challenge that is inherent in word puzzles.

A further object of the invention is to provide a word puzzle aid which progressively supplies clues towards solving for an unknown word in a word puzzle.

It is yet another object of the invention to provide a word puzzle aid which permits the visualization of both vertically and horizontally positioned words in a word puzzle.

SUMMARY OF THE INVENTION

The invention provides a word puzzle aid for assisting in the solution of an unknown word by substituting combinations of unknown letters with letters known to exist in the unknown word. According to one embodiment of the invention, a plurality of elongated strips are retained within a housing. Each of the elongated strips has the letters of the alphabet printed alphabetically and vertically thereon. A window extends across a top wall of the housing in a direction substantially perpendicular to the length of the strips, thus permitting the letters printed on the strips to be viewed horizontally through the window. The elongated strips are moveable through an opening formed by the walls of the housing and in a direction substantially parallel to their elongation. A word having unknown letters is solved by advancing the elongated strip, or strips, having the unknown letter to obtain different combinations of each letter of the alphabet with the known letters in the word, in such a way that the different letter combinations are viewed through the window of the housing.

In another embodiment of this invention, in addition to the arrangement described above, a second window is provided in the bottom wall of the housing, and the alphabet is printed horizontally on the backs of the strips. In this arrangement the letters of the word will be displayed vertically in the window when the puzzle aid is oriented with the strips extending horizontally in the housing. Thus the person using the aid may view the word either horizontally or vertically as the word may appear "across" or "down" in a cross word puzzle.

BRIEF DESCRIPTION OF THE DRAWING

The foregoing objects and advantages of the present invention will be more clearly understood in connection with the accompanying drawing in which.

DETAILED DESCRIPTION OF THE PREFERRED EMBODIMENT

Figures 1, 2:
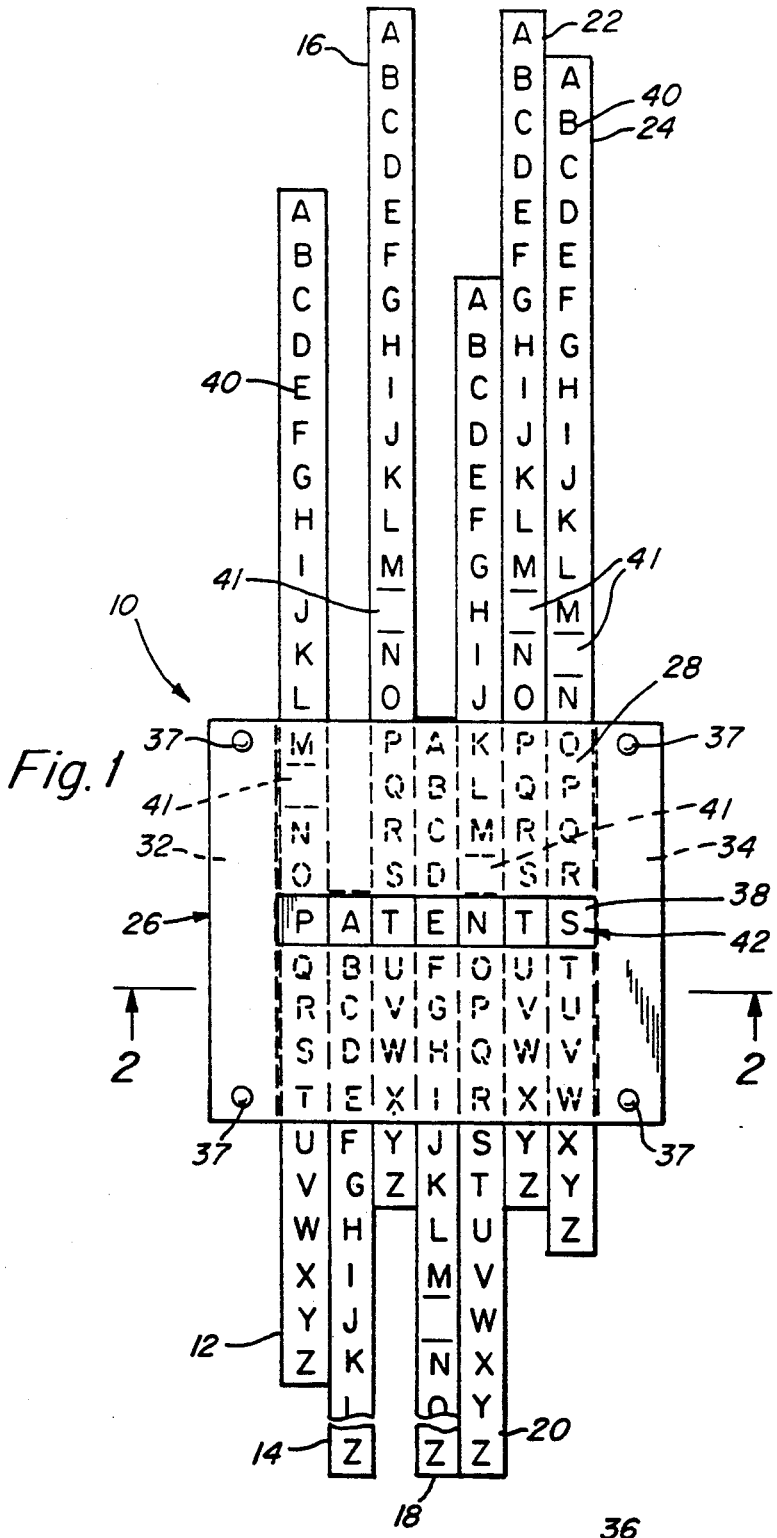
FIG. 1 is a front view of the word puzzle aid.
FIG. 2 is a cross sectional view taken on the section line 2—2 of FIG. 1.
Figure 3:
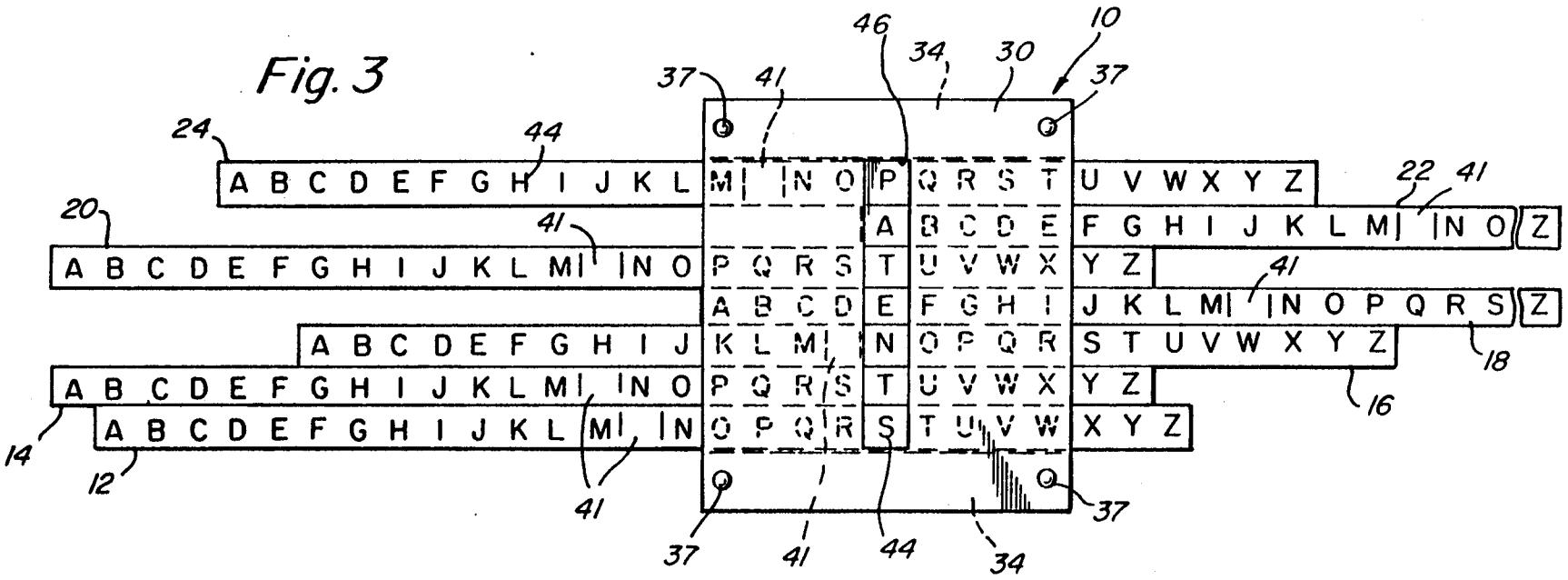
FIG. 3 is a rear view of the device shown in FIG. 1.

The word puzzle aid 10 shown in FIGS. 1–3 of the drawing includes a plurality of elongated strips 12, 14, 16, 18, 20, 22, 24, which are retained with in a housing 26. The housing 26 is formed by a top wall 28, bottom wall 30 and side walls 32 and 34. An opening 36, through which the strips 12 to 24 extend, is defined by the top, bottom and side walls 28, 30, 32 and 34 respectively. A rivet 37, or other securing device such as a screw or an adhesive, secures the four walls together. Alternatively, the housing 26 could be of one piece construction, such as may be formed by molded plastic.

The top wall 28 of the housing 26 includes a window or opening 38 for viewing the letters of the alphabet 40 printed on the strips 12 to 24. The printed letters 40 are alphabetically arranged and oriented vertically along the strips in such a manner that the letters 40 which appear through the window 38 form a horizontally oriented word 42, as viewed through the window.

Preferably a blank space 41 is provided in each strip between the letters "M" and "N", the middle letters of the alphabet, to establish a neutral or starting position for each strip that occupies the space of an unknown letter in the word to be solved. This feature is explained more fully below in connection with the use of the word puzzle and of this invention. As can be seen in FIG. 2, the strips 12 to 24 are positioned within and retained by the top and bottom walls 28, 30 and side walls 32, 34 so that their movement is restricted to a longitudinal direction.

In use, any of the strips 12 to 24 which have the letters known to form part of the word to be solved are positioned such that the known letters 40 are viewed through the window 38. Those strips in the position of the unknown letters may initially be place so that their blank spaces 41 are viewed through the window 38. The strips 12 to 24 which have the unknown letters are then moved longitudinally so that selected letters of the alphabet are combined with the known letters to assist in determining the unknown word. For situations involving a word with more than one unknown letter, various permutations of the unknown letters can be obtained at any one time by moving each of the various strips in the position of the unknown letters. In the example shown in FIG. 1 by moving the strips 12 and 24 so that the letters "P" and "S" of the respective strips are in the window, the unknown word "PATENTS" is revealed. Also relevant to words having more than one unknown letter, is the use of the invention to supply, progressively, various letters for one unsolved letter at a time, thereby minimizing the user's reliance on this crutch in obtaining his or her own answer.

It will be appreciated that arrangement of the window 38 and lettering on the strips as shown in FIG. 1 is particularly useful in solving for horizontally positioned words, for example the "across" row of a crossword puzzle, but would also be useful for vertically positioned, "down" words, of a crossword puzzle. The arrangement shown in FIG. 3 is particularly suitable for solving "down" words.

FIG. 3 is an illustration of the bottom side of the word puzzle device 10. The bottom side of the invention includes letters 44 of the alphabet printed horizontally and in alphabetical order along the strips 12 to 24. Note also the presence of the blanks 41 between the letters "M" and "N". The letters 44 viewed through the window 46 in the bottom wall 30 are thus positioned vertically to assist in solving for vertically positioned words, such as would appear in the "down" column of a crossword puzzle. By longitudinally moving any of the plurality of strips 12 to 24, different combinations of letters 44 can be viewed through window 46. This alternative or bottom side of the invention is in all other respects the same as the top side shown in FIG. 1.

It should be appreciated that in a simple form of the invention the strips may be lettered on only one side, and a single window may be provided such as is shown in FIG. 1, and the backs of the strips and the bottom wall of the housing would not include the letters and window. A more sophisticated embodiment of the invention, on the other hand, may have a front or top surface as appears in FIG. 1 and a bottom surface that is configured as shown in FIG. 3. The latter embodiment would be particularly convenient for solving both "across" and "down" words in a crossword puzzle. As yet another embodiment the bottom side of the word puzzle device 10 could have the letters of a foreign language printed thereon, thereby enabling the word puzzle device to be used bilingually. Such an application of the invention would be particularly useful in the bilingual areas, such as Puerto Rico etc.

The foregoing detailed description is meant to be illustrative, and not limiting, of the invention. It will be understood by those of ordinary skill in the art that various modifications can be made without departing from the spirit or scope of the invention.

What is claimed is:

1. A word puzzle device comprising:

a plurality of elongated strips each having two sets of equally spaced letters, wherein one of said sets is oriented vertically and another of said sets is oriented horizontally, a housing for retaining said plurality of strips in parallel, said plurality of strips being arranged in a side by side orientation and movable with respect to one another in the housing, said housing having a first opening for viewing said vertically oriented letters and a second opening for viewing said horizontally oriented letters on each of said plurality of strips, wherein said strips are moveable so that different letter combinations can be viewed through said openings.

2. A word puzzle device as claimed in claim 1 wherein said vertically oriented set of letters is disposed on one side of each of said plurality of strips, and said horizontally oriented set of letters is disposed on an opposing side of said plurality of strips.

3. A word puzzle device as claimed in claim 1 wherein said letters are alphabetized letters of the alphabet.

4. A word puzzle device as claimed in claim 1 wherein said housing comprises a pair of opposite sides, each of said sides having an opening for viewing selected letters on one side of said strips.

5. A word puzzle device as claimed in claim 1 further characterized by a central passage in said housing, said plurality of strips extending through and being longitudinally movable in said passage.

6. A word puzzle device comprising:

a plurality of elongated strips each having a horizontally oriented set of letters of the alphabet printed on one side thereof and a vertically oriented set of letters on the other side, a housing for retaining said plurality of strips in parallel, said housing having an opening for selectively viewing said letters on each of said strips, wherein said strips are moved to view different combinations of letters through said opening.

7. A word puzzle device as claimed in claim 6, wherein said letters on said strips are alphabetized letters of the alphabet.

8. A word puzzle device as claimed in claim 7 wherein a blank space is provided on each strip to enable a blank for any of the strips to be viewed through the opening.

9. A word puzzle device as claimed in claim 6, wherein said housing has a top surface and a bottom surface each having an opening for viewing said vertically and said horizontally oriented sets of letters on each of said plurality of strips.

10. A word puzzle device comprising:

a plurality of elongated strips each having two sets of equally spaced letters, wherein one of said sets is oriented vertically and the other of said sets is oriented horizontally on the top and bottom surfaces thereof, said letters being the letters of the alphabet arranged alphabetically, a housing for retaining said plurality of strips in parallel and having top and bottom walls, said strips being individually longitudinally moveable in said housing, said top and bottom walls each having an opening for selectively viewing said letters on said strips, wherein said strips are moved to view different combinations of letters through either of said openings.

* * * * *